US005354255A

United States Patent [19]

Shapiro

[11] Patent Number: 5,354,255

[45] Date of Patent: Oct. 11, 1994

[54] DECANTER CENTRIFUGE WITH CONVEYOR CAPABLE OF HIGH SPEED AND HIGHER FLOW RATES

[75] Inventor: Leonard Shapiro, Doylestown, Pa.

[73] Assignee: Alfa Laval Separation Inc., Warminster, Pa.

[21] Appl. No.: 992,327

[22] Filed: Dec. 17, 1992

[51] Int. Cl.[5] ..... B04B 1/20

[52] U.S. Cl. ..... 494/53

[58] Field of Search ..... 494/52–54, 494/82; 366/319, 320, 322; 210/360.1, 377, 380.1, 380.3

[56] References Cited

U.S. PATENT DOCUMENTS

| | | | |
|---|---|---|---|
| 924,376 | 6/1909 | Phillips . | |
| 1,230,560 | 6/1917 | Camp . | |
| 1,572,299 | 2/1926 | McEntire . | |
| 2,174,857 | 10/1939 | Vogel-Jorgensen . | |
| 2,578,456 | 12/1951 | Smith . | |
| 2,612,314 | 9/1952 | Huelsdonk | 494/53 X |
| 2,622,794 | 12/1952 | Smith . | |
| 2,679,974 | 6/1954 | Gooch | 494/53 X |
| 2,734,681 | 2/1956 | Schmiedel . | |
| 2,740,580 | 4/1956 | Schmiedel | 494/53 |
| 2,766,930 | 10/1956 | Schmiedel . | |
| 3,423,015 | 1/1969 | O'Conor . | |
| 3,764,062 | 10/1973 | Brautigam . | |
| 3,795,361 | 3/1974 | Lee . | |
| 3,885,734 | 5/1975 | Lee | 494/53 X |
| 3,904,109 | 9/1975 | Underwood . | |
| 3,934,792 | 1/1976 | High et al. . | |
| 3,955,756 | 5/1976 | Hiller | 494/53 X |
| 4,006,855 | 2/1977 | Merzenich . | |
| 4,009,823 | 3/1977 | Nozdrovsky . | |
| 4,186,097 | 1/1980 | Dudley et al. | 210/377 |
| 4,209,128 | 6/1980 | Lyons . | |
| 4,245,777 | 1/1981 | Lavanchy . | |
| 4,328,925 | 5/1982 | Shapiro . | |
| 4,332,350 | 6/1982 | McClellan . | |
| 4,339,072 | 7/1982 | Hiller . | |
| 4,566,873 | 1/1986 | Toda | 494/53 |
| 4,617,010 | 10/1986 | Epper et al. | 494/52 |
| 4,743,226 | 5/1988 | Day et al. | 494/53 |
| 4,784,634 | 11/1988 | Schiele | 494/52 |
| 4,828,541 | 5/1989 | Madsen | 494/53 |
| 5,024,649 | 6/1991 | Smith | 494/85 |
| 5,147,277 | 9/1992 | Shapiro | 494/53 |
| 5,182,020 | 1/1993 | Grimwood | 494/53 X |

FOREIGN PATENT DOCUMENTS

| | | | |
|---|---|---|---|
| 064505 | 5/1946 | Denmark . | |
| 0348213 | 12/1989 | European Pat. Off. . | |
| 2907318 | 8/1980 | Fed. Rep. of Germany | 494/54 |
| 3335873 | 2/1985 | Fed. Rep. of Germany | 494/53 |
| 1271244 | 7/1961 | France | 494/53 |
| 0453726 | 2/1951 | Italy . | |
| 240248 | 2/1990 | Japan | 494/53 |
| 347084 | 8/1972 | U.S.S.R. | 494/54 |
| 0274406 | 9/1926 | United Kingdom . | |
| 91/13686 | 9/1991 | World Int. Prop. O. . | |

*Primary Examiner*—David A. Scherbel
*Assistant Examiner*—Charles Cooley
*Attorney, Agent, or Firm*—Seidel, Gonda, Lavorgna & Monaco

[57] ABSTRACT

The conveyor of a decanter centrifuge includes a small outside diameter central hub extending for at least a portion of the longitudinal length. On the hub is attached a series of longitudinally- and radially-extending shaped ribs, which in turn attach to larger ribs that transverse an open feed zone. The longitudinal and transversing ribs support a ribbon conveyor flight. The open feed zone serves to decrease feed solids degradation. The ribs outside the feed zone serve to improve interface stability and minimize washout. The overall structure of the conveyor is mechanically stiffer and less prone to vibration. The conveyor is lighter and less expensive to construct.

24 Claims, 6 Drawing Sheets

DECANTER CENTRIFUGE WITH CONVEYOR CAPABLE OF HIGH SPEED AND HIGHER FLOW RATES

FIELD OF THE INVENTION

The present invention relates to centrifuges, particularly decanter-type centrifuges. The decanter centrifuge of the invention includes a conveyor having structural elements surrounding the feed zone, the clarification zone toward the liquid discharge, and the discharge zone toward the solids discharge that improve stability, the overall operation, particularly during thickening at high rates.

BACKGROUND OF THE INVENTION

A decanter centrifuge generally comprises an imperforate bowl mounted for rotation about its central longitudinal axis. The bowl typically includes a cylindrical section and a frusto-conical section at one end. A screw conveyor is coaxially mounted within the bowl and adapted for rotation at a differential speed with respect to the bowl. The screw conveyor typically comprises a central hub having a series of conveyor flights extending radially therefrom and forming a helix along the length of the hub.

The rotation of the bowl of the decanter centrifuge creates a centrifugal force which separates a liquid feed mixture or slurry into its constituent parts. The feed mixture within the bowl forms a cylindrical pond, with a ring or layer of the heavy constituent material(s) adjacent the inside bowl wall and a ring or layer of the lighter constituent material(s) radially inward of the heavy material layer.

The terms "heavy phase" and "light phase" are often employed to describe the materials which are separable from the feed mixture by the application of centrifugal force within a centrifuge. In a centrifuge having a conveyor, the light phase material will usually be a liquid and the heavy phase material will usually be a mixture of solids, also including some liquid. The liquid feed mixture or slurry introduced into the bowl has a specific concentration of suspended solids or other insoluble material therein. These solids are concentrated by the centrifugal force to form the heavy phase mixture within the bowl, including coarse solids, fine solids and liquid. Because of the variations in density of the solids as well as the varying effect of the centrifugal force acting on the feed within the bowl, the concentration of the separated heavy phase (expressed as a percent solids) varies at different positions within the centrifuge bowl. The concentration of the heavy materials that do not settle or separate from the light phase material also varies (expressed as milligrams per liter). The term "interface" is often employed to define the dividing line between the heavy and light phase layers formed within the bowl. The location of the interface within the bowl will vary depending upon the operational parameters of the centrifuge, the axial position within the bowl and the qualities of the feed mixture. In describing the operation of the centrifuge, the interface is often visualized as a sharp dividing line. However, as presently understood, the interface in a typical liquid/solids-type separation of a decanter centrifuge is in the form of a concentration gradient or transition zone of indeterminate thickness.

The discharge of the heavy phase material from the bowl of a decanter centrifuge is accomplished as a function of the differential rotation of the conveyor with respect to the bowl. The differential speed causes the conveyor flights to move the heavy phase material along the inside bowl wall toward the tapered end of the bowl. A discharge path is provided at the restricted end of the bowl, with the conveyor flights moving the heavy phase over a weir surface. The clarified light phase material typically flows in an opposite direction from that of the heavy phase. A light phase discharge path is provided in the cylindrical end of the bowl, with the liquid also flowing over weir surfaces. The intent of a decanter centrifuge is to continuously and separately discharge the heavy phase and light phase constituent parts of the feed mixture.

One form of a decanter centrifuge is shown in Brautigam U.S. Pat No. 3,764,062. The cylindrical hub of the centrifuge conveyor includes a central hollow portion having a series of openings positioned at various locations around the periphery of the hub. A feed tube introduces the feed into the hub. The feed mixture is discharged through the openings directly into the bowl. The Brautigam patent is herein incorporated by reference.

Lavanchy U.S. Pat. No. 4,245,777 shows a variation of the Brautigam decanter centrifuge. The Lavanchy centrifuge includes a feed cone within the bowl, projecting from the periphery of the conveyor hub. The feed cone directs the feed material from the openings in the conveyor hub into the bowl. The conical surface of the feed cone includes a series of accelerator veins thereon for directing the feed liquid down the surface of the cone. This Lavanchy patent is also incorporated herein by reference.

Lee U.S. Pat. No. 3,795,361 shows in one embodiment a decanter centrifuge having a conical feed cone within the bowl. The Lee feed cone projects radially outward within the bowl, through the interface and into the heavy phase/solids layer. An alternate structure shown in Lee includes a baffle in the form of an annular disc. The Lee cone and disc type baffles assist in creating a centrifugal pressure head within the bowl to assist the discharge of the heavy phase from the bowl. This centrifugal pressure head is also created by positioning the weir surfaces of the light phase discharge path radially inward of the position of the heavy phase weir surfaces (known as the "spillover" position). This Lee patent is also incorporated herein by reference.

The projection of the annular cone or radial disc within the Lee-type decanter centrifuge forms a separating zone for the feed mixture between the baffle and the liquid discharge end of the bowl. On the opposite side of the baffle is created a discharge zone for the heavy phase. Only the heavy phase passes under the radial periphery of the baffle due to the seal formed with the heavy phase layer. Because of the creation of a seal at the radial periphery of the baffle, a pressure imbalance may be created within the separating zone of the bowl to provide a discharge force through the restricted passageway (formed by the baffle and the inside bowl wall) for the discharge of heavy phase from the conical bowl portion through the heavy phase discharge path.

A loss of a seal between the baffle and the heavy phase layer in the Lee-type decanter centrifuge creates a condition called "washout". A washout is a sudden reduction in the solids concentration being discharged from the centrifuge due to the underflow of both heavy and light phase through the restricted passage and into the discharge zone. This washout is typically visualized by the interface in the separating zone moving close to or beyond the radial periphery of the baffle, allowing the centrifugal pressure head to drive feed material into the heavy phase discharge end and out of the heavy phase discharge path from the bowl.

A typical application for a Lee-type decanter centrifuge is in a thickening operation. Thickening is generally defined as discharging a heavy phase cake which is less than 10% solids. Usually the appearance of a thickened heavy phase is that of a viscous pudding. In certain thickening applications, difficult-to-convey materials can only be discharged from a decanter centrifuge by a Lee-type construction. A dewatering-type operation, differing from thickening, generally includes a level of dryness in the discharged heavy phase that is greater than a 10% concentration. The viscosity of the normal dewatered heavy phase is typically much greater than that of the thickening-type operation. In some dewatering applications, the Lee-type construction is not required.

Typically, the performance of a decanter centrifuge, including the Lee-type centrifuge, improves with an increase in the length of the separating zone and/or an increase in the rotational speed of the bowl. Modern materials and equipment have permitted greater rotational speeds that result in an increase in the "G" level acting to separate the feed mixture within the bowl. However, the length of the bowl is typically limited by the natural frequency of the conveyor as positioned on its bearings. The natural frequency must be higher than the maximum operating speed in order to avoid destructive vibration. As a result of this physical relationship, typically, decanter centrifuges have included large diameter conveyor hubs so as to provide the necessary transverse and torsional stiffness.

One way of increasing the length of the separation zone in the bowl is to increase the angle of the frusto-conical portion of the bowl, i.e., increasing the angle between the beach and the axis of rotation. A deeper pond is desirable because it increases the residence time of the feed and, thus, improves capacity. Deeper ponds obtained by reducing the radius of the pond surface also result in lower power demand by the centrifuge. This reduced power demand is proportional to the square of the discharge radius for the clarified liquid and solids. As an example, the reduction of the pond radius by twenty percent will result in a 44% reduction of power demanded by the centrifuge. This modification also reduces turbulence in the feed portion of the separation zone.

The rate of feed into the centrifuge is also a determining factor in the success of the overall separation operation. Not only will the fixed rate affect the time for which a mixture is subject to centrifugal force, but such may also cause turbulence that remixes already separated heavy phase/solids. For example, the openings in the conveyor hub in the Brautigam patent (discussed above) at high rates creates jets causing turbulence within the feed portion of the separating zone. If this type feed structure is positioned adjacent a Lee-type baffle, secondary flows may also be created, resulting in relatively high velocities at the interface. Turbulence and secondary flows near the interface make stability difficult and a washout more likely. This may be particularly true where the viscosity of the heavy phase decreases as the flow velocity increases, making loss of seal more likely.

BRIEF SUMMARY OF THE INVENTION

The present invention relates to centrifuges and is particularly contemplated to be directed to a decanter-type centrifuge for separately discharging light and heavy phase constituents of a feed mixture. The present invention relates to the conveyor portion of a centrifuge. Preferably, the conveyor of the present invention includes a radially extending baffle that operates in conjunction with the centrifugal pressure head defined by the Lee patent (discussed above).

The conveyor of the present invention includes a central hub extending for a portion of the longitudinal length of the centrifuge bowl. In one embodiment, the central hub extends for a portion of the separating zone of the centrifuge and also for a portion of the frusto-conical section of the bowl. The hub is preferably positioned radially inward of the spillover position within the bowl (defined by the heavy phase weir surface). The conveyor further includes a series of longitudinally-extending ribs attached to the central hub and projecting radially from the hub. The conveyor flights are mounted on the outside edges of the ribs in both the separating zone and the discharge zone of the bowl.

An additional feature of the conveyor of the present invention is the creation of a housing free feed zone. The feed zone is axially located between the cylindrical section of the conveyor hub portion and the conical section of the conveyor hub portion. The radially outer boundary of the feed zone includes a series of ribs extending radially from a position "below spillover" (i.e., the inside radius of the ribs is larger than the solids discharge radius) and then into the pond. The ribs also form structural support for the conveyor by extending axially across the feed zone and by being attached at opposite ends to the two conveyor hub portions. The ribs are totally immersed into the pond. This ribbed region outward of the feed zone of the conveyor hub is the feed portion of the separation zone.

A feed pipe extends along the axis of the conveyor into the area between the two cylindrical hub portions. The feed zone is substantially unobstructed between the feed pipe outlet and the radially inward position of the ribs within feed portion of the separation zone. The helical flight preferably extends along the axial length of the conveyor, including the feed zone.

A series of channels are created between adjacent ribs radially outward of the conveyor hub in both the cylindrical portion and the frusto-conical portion of the bowl. The conveyor hub of the present invention is preferably positioned radially inward of the pond surface. Thus, a restriction to the flow between the feed point and the light phase discharge path is defined by the series of conveyor flights as well as by the radially-extending ribs which extend longitudinally along the length of the conveyor hub. A series of openings may be provided within the ribs in the separating zone of the centrifuge so as to permit crossover flow. The open feed zone substantially reduces the acceleration of the feed into the bowl. Thus, the lack of restrictions within the feed zone and the discontinuation of the conveyor hub permits the feed to move slowly in the radial direction upon its introduction into the bowl, and eliminates nozzles and resulting secondary flows, which may cause further turbulence. Also, the provision of radially-extending ribs within the frusto-conical portion provides a positive deceleration of the heavy phase moving inward toward the decanter centrifuge solids discharge openings.

Further structures and instrumentalities are contemplated for use with the present invention. These structures will be discussed in more detail below and will be apparent to those skilled in the art upon review of the specification and drawings.

BRIEF DESCRIPTION OF THE DRAWINGS

For the purpose of illustrating the present invention, there is shown in the drawings a form which is presently preferred; it being understood, however, that this invention is not limited to the precise arrangements and instrumentalities shown.

DETAILED DESCRIPTION OF THE INVENTION

Figure 1:
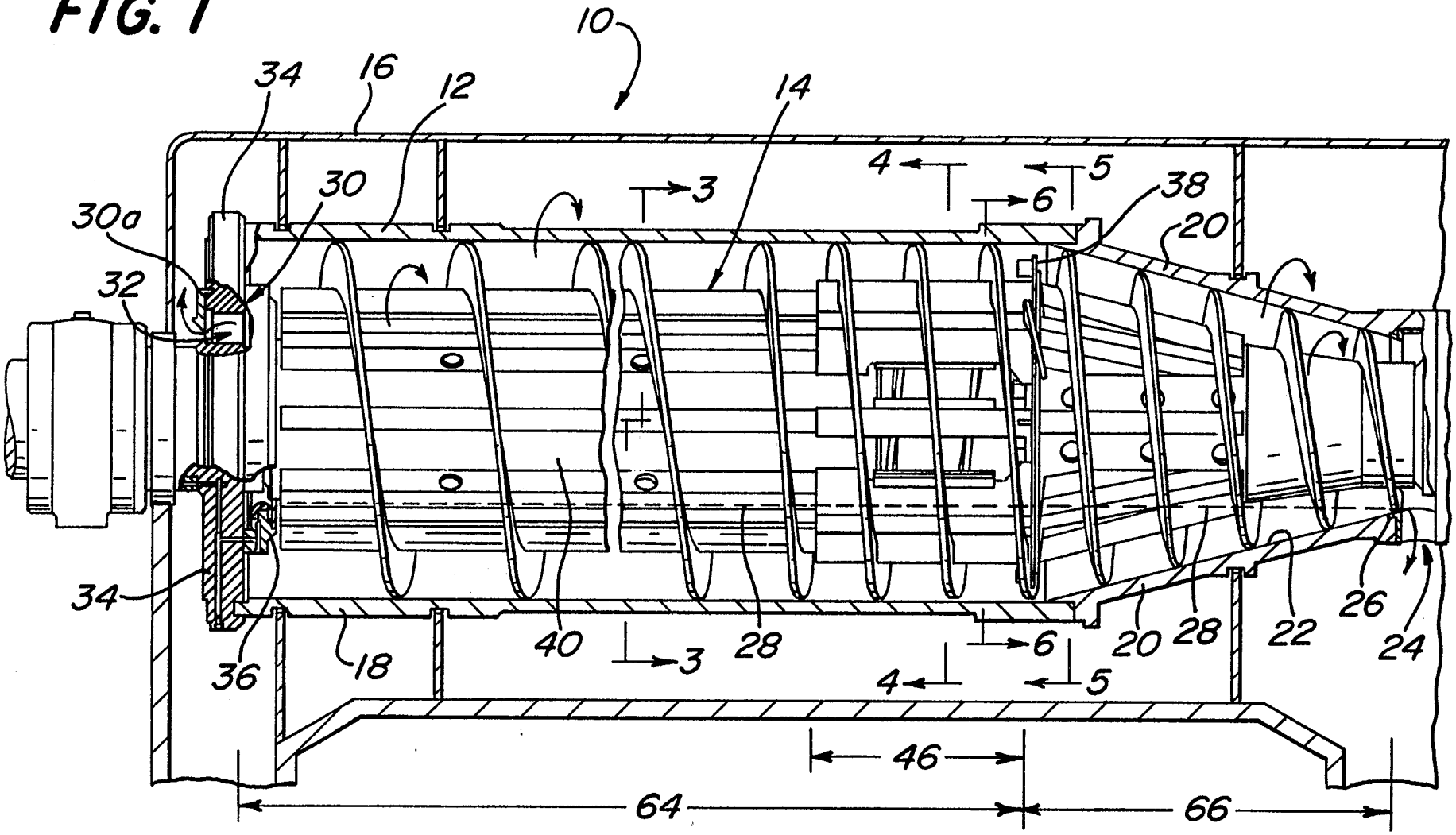
FIG. 1 shows a side plan view of a decanter centrifuge including a conveyor in accordance with the present invention.

In the drawings, where like numerals indicate like elements, there is shown in the figures a decanter centrifuge which is generally referred to by the numeral 10. With reference to FIG. 1, the decanter centrifuge 10 generally comprises an imperforate bowl 12 (shown in cross section) which is mounted for rotation about its central longitudinal axis. Coaxially mounted within the bowl is a screw conveyor 14. Surrounding the bowl 12 is a casing or housing 16 (also shown in cross section).

The bowl 12 generally comprises a cylindrical section 18 and a frusto-conical or tapered section 20. The inclined surface of the tapered section 20 is generally referred to as the beach 22. At the top of the beach 22 (at the smaller radius end of the tapered section 20) there is provided a discharge path 24 for discharge of the heavy phase material from the bowl 12. The heavy phase material, which is separated by the centrifugal force created by rotation of bowl 12, is moved by the conveyor 14 (rotating at a slightly different speed than the bowl) along the inside surface of the bowl 12 and up the beach 22, and is discharged over weir surfaces 26 (one being shown in FIG. 1) at the edge of the discharge path 24. The radial position of the heavy phase discharge weir surface 26 generally defines the "spillover" position within the bowl. The spillover line is referred in the figures by the numeral 28.

As illustrated in the figures, the conveyor 14 includes flights (62) having a right-handed pitch. Thus, for discharge of the heavy phase to occur through path 24, the bowl 12 will rotate at a speed less than that of the conveyor 14. It should be noted that a left-handed conveyor pitch is also possible with the differential speed being created by the bowl rotating faster than the conveyor.

At the end of the bowl 12, opposite the tapered section 20, is provided a light phase discharge path 30. The light phase discharge path 30 is defined by a series of openings 32 in the bowl head 34. As illustrated, the bowl head 34 is provided with means 36 for adjusting the radial position of the pond surface within the bowl 12. This adjustment means 36 as illustrated is formed in accordance with U.S. Pat. No. 5,257,968 and allowed on May 4, 1993 and titled "INFLATABLE DAM FOR A DECANTER CENTRIFUGE". This '968 patent is herein incorporated by reference. Adjustment means 36 is contemplated to be capable of positioning the pond surface within the bowl radially inward of spillover line 28. A ring dam **30*a* may also be used in place of means 36** to set the pond surface.

The screw conveyor 14 further comprises a radially extending disc 38 located adjacent the joint between the cylindrical section 18 and the tapered section 20 of the bowl 12. The disc 38 is contemplated to extend into the heavy phase layer within the bowl (not shown) during separation of the feed. The operation of the adjustment means 36 or ring dam **30*a* at a position where the pond surface is above-spillover, in conjunction with the formation of a restricted passageway by disc 38**, creates a centrifugal pressure head and a supplemental discharging force for the heavy phase added to the discharge force created by the differential speed of the bowl and the helical conveyor flights, in accordance with Lee U.S. Pat. No. 3,795,361 (discussed above and herein incorporated by reference).

As shown in FIG. 1, the bowl 12 of the centrifuge 10 is generally divided into a separation zone 64 and a discharge zone 66. In a centrifuge with a baffle or disc 38, the dividing line between these zones 64, 66 is the restricted passageway formed by the baffle 38 and the bowl wall 18. Adjacent baffle 38 on the separation zone 64 side thereof is a feed portion 46 wherein the feed liquid is introduced into the bowl from the feed zone 50 within the conveyor hub 40, as seen in FIG. 2.

Figure 2:
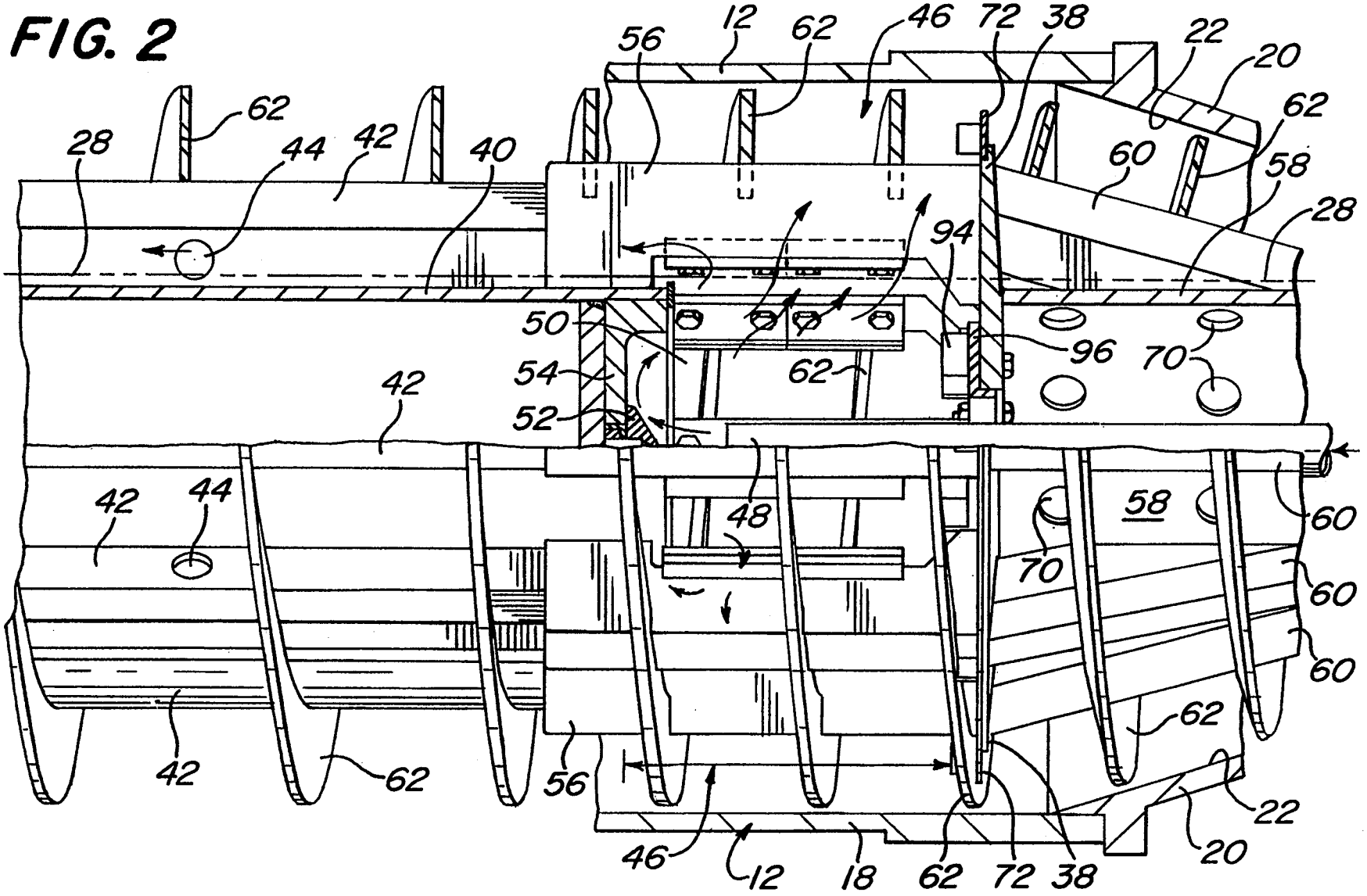
FIG. 2 shows an enlarged view of the conveyor shown in FIG. 1 with portions thereof shown in cross-section.

The screw conveyor 14 of the present invention shown in FIG. 1 is more particularly illustrated in FIG. 2. The conveyor 14 generally comprises two cylindrical hub sections 40 and 58, each having an outside radius less than the radius of the spillover line 28. Thus the first hub section 40 and the second hub section 58 are positioned radially inward of the weir surfaces 26 of the heavy phase discharge path 24 (FIG. 1) and, preferably, radially inward of the maximum pond surface position created by adjustment means 36. Thus, both hubs 40 and 58 do not touch the pond within the rotating bowl. The first hub section 40 is generally formed within the cylindrical section 18 of the bowl 12. Projecting radially outward therefrom is a series of ribs 42. The ribs 42 project from the hub 40 to a position well below spillover line 28. A series of openings 44 are provided within the ribs 42 along the axial length of the first hub section 40. The openings 44 permit light phase/liquid to flow between adjacent channels (or chambers) formed by the ribs 42 to equalize the flow.

Adjacent to the first hub section 40 is formed a feed portion 46 of a separating zone 64. The feed mixture is introduced into this portion 46 from the feed zone 50, which in turn receives feed from feed pipe 48. The feed pipe 48 extends along the central axis of the conveyor 14 (and the bowl 12). The feed mixture is introduced into the feed zone 50 formed radially inward of the spillover line 28 adjacent to hub section 40. The feed exits feed pipe 48 and strikes the feed target 52 provided on wall 54 which closes the first hub section 40. The feed then enters the feed zone 50. Thereafter, the feed moves radially outward into the feed portion 46 of the separation zone 64.

A second set of radially-extending ribs 56 is formed within the feed portion 46 of separating zone 64, between the first set of ribs 42 and baffle 38. These feed ribs 56 are rigidly joined to the first hub section 40 as well as to the disc 38 and ribs 42. As will be discussed in further detail below, feed ribs 56 form a stiff structural continuity of the conveyor 14 within the feed portion 46. The feed ribs 56 initiate at a radial position below (radially outward of) the spillover line 28 (and thus below the pond surface within the bowl) and extend radially outward therefrom. The extension of the feed ribs 56, as is illustrated in FIG. 2 (and the subsequent figures), is preferably greater than that of the first set of ribs 42.

Within the tapered portion 20 of the bowl 12 is provided a second cylindrical hub section 58. The second hub section 58 includes a series of radially-extending ribs 60. This third set of ribs 60 extend radially from the hub 58 with their peripheral edge being angled with respect to hub 58 at approximately the same taper as beach 22. Preferably, this third set of ribs 60 is of generally the same shape and structure as the first set of ribs 42 except for the angling with respect to the hub section 58. As illustrated, the hub 58 may have a series of openings 70 provided therein to reduce the overall weight of the rotating structure, permit spillover from feed zone 50 to pass into the pond, and permit venting of the interior of the hub 58 into the casing 16 through solids opening 24. Ribs 60 are rigidly joined to the solids discharge zone face of disc 38 and to hub 58.

As can be seen in FIG. 2 (as well as FIG. 3 and 4), a continuous helical conveyor flight 62 is provided along the length of the conveyor 14. Conveyor flight 62 generally forms a conveyor whose inside diameter is not directly in contact with the conveyor hub 40 or 58. The conveyor flight 62 is attached to the peripheral surface of the rib sets 42, 56 and 60 and disc 38. Feed ribs 56 are contemplated to extend radially past (outward of) the extension of the first set of ribs 42. Notches are formed on the inside edge of the flight 62 as it passes over the feed ribs 56. An open area with radial ribs is defined radially inward of the inside surface of the conveyor flight 62, including the separating zone 64 (which includes the feed portion 46) and the discharge zone 66 (see FIG. 1). As seen in FIGS. 1 and 2, the pitch of the conveyor flight 62 in the feed portion of the separation zone 46 and the discharge zone 66 is decreased from that in the remainder of the separating zone 64.

Typically, large diameter hubs are used to develop the necessary transverse and torsional stiffness of the conveyor within a decanter centrifuge. As indicated previously, the natural frequency of the conveyor must be significantly higher than the maximum operating rotational speed in order to avoid destructive vibration. On existing decanter centrifuges, a reduction in the hub diameter substantially lowers the natural frequency of the conveyor, and thus limits the speed of the centrifuge. Not only will the low natural frequency affect successful operation, but in long conveyors, deflection of the conveyor may cause destructive contact between the conveyor flights and the inside of the bowl wall.

In the conveyor 14 as shown and contemplated by the present invention, the diameter of hub sections 40 and 58 have been reduced substantially so that even with a greatly reduced spillover radius, the pond surface 28 does not touch the outside diameter of hub portions 40 and 58. In order to create the necessary stiffness for high speed operation, ribs 42 and 60 have been added. In the area of the feed portion 46 of separating zone 64, the hub has been eliminated completely. The feed ribs 56 form the structural continuity of the conveyor 14 along the length of the feed zone 50 and the discontinuity of the conveyor hub sections 40 and 58. As illustrated, the feed ribs 56 are generally heavier, i.e., larger in cross-section, than the first or third set of ribs 42 and 60, respectively. The relative dimensional relationship between these ribs is illustrated in FIG. 3.

Figure 3:
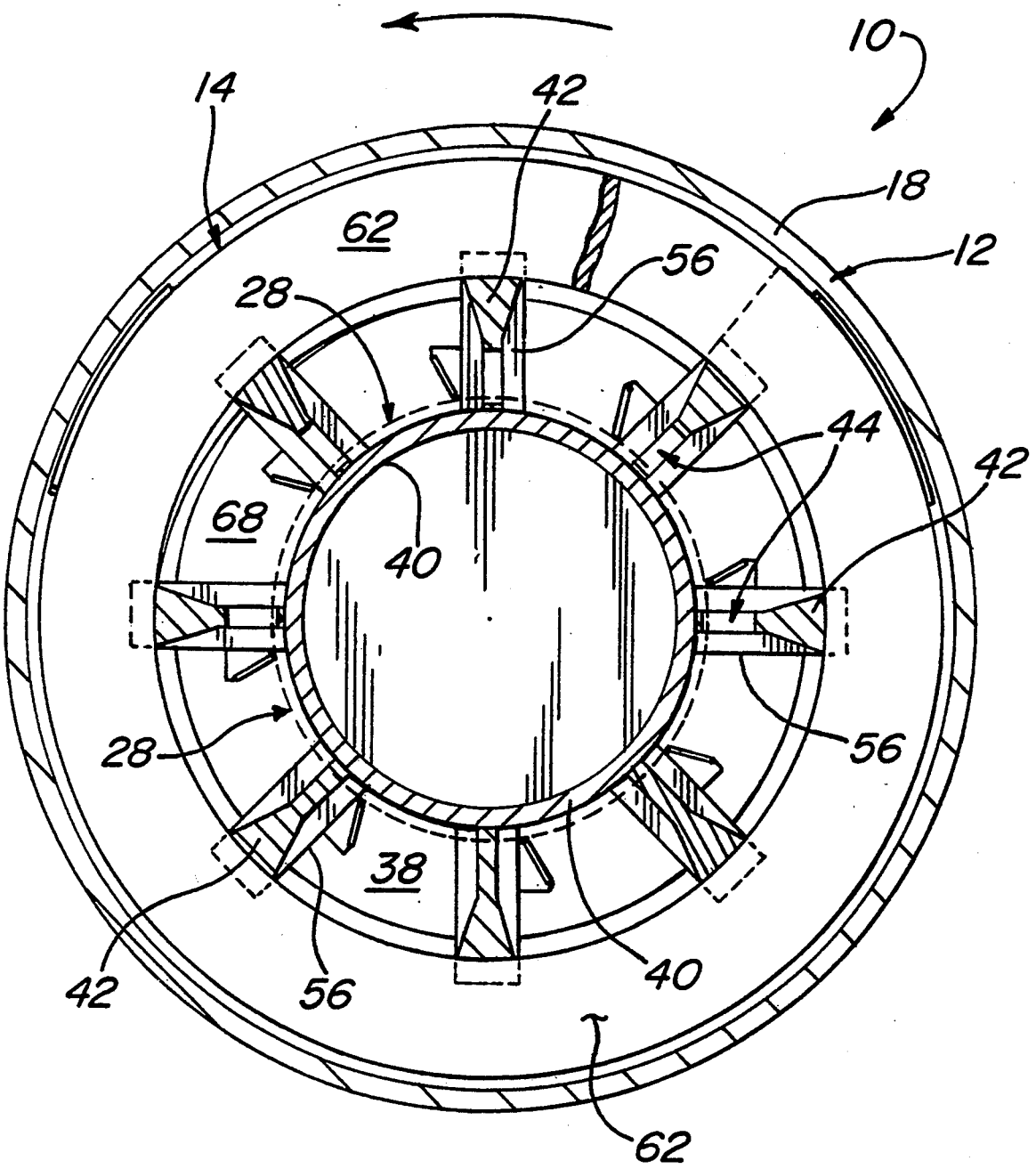
FIG. 3 shows a cross-sectional view of the separating zone of the decanter centrifuge as taken along line 3—3 in FIG. 1.

FIG. 3 shows a cross-sectional view of the decanter centrifuge 10 of the present invention. The cylindrical portion 18 of the bowl 12 concentrically surrounds the conveyor 14. The conveyor flight 62 spirals around ribs 42 and 56 and the cylindrical conveyor hub 40. The peripheral edge of the conveyor flight 62 is positioned closely adjacent the inside surface of the wall of bowl 12. In the cylindrical section 18 of the bowl 12, the radially-extending ribs 42 are attached to the periphery of the conveyor hub 40 and extend outwardly therefrom. The conveyor flight 62 is attached to the peripheral edge of the ribs 42 and 56.

As illustrated in FIG. 3, certain ribs 42 are shown having openings 44 therethrough for cross flow of liquid between the channels formed thereby to assure uniform flow distribution. The generally axial flow path for the liquid flow radially inward of the conveyor flight 62 and outward of the conveyor hub 40 is generally identified by the numeral 68.

In FIG. 3, the separating zone 64 side of baffle 38 is visible. In addition, the feed ribs 56 outside of the feed zone 50 (see FIG. 2) are also visible. The feed ribs 56 have a heavier cross-section than that of the first set of ribs 42. As indicated previously, the larger size of the feed ribs 56 is for structural continuity and stiffness of the conveyor in the area where the conveyor hub is discontinued. The first set of ribs 42 have a non-symmetrical cross-section. The form of this cross-section as illustrated is intended to maximize the cross-sectional area at the outer periphery of the ribs and to maximize the bending moment of inertia (also called the transverse moment of inertia) of the composite section consisting of tube 40 and ribs 42 while minimizing the suspended weight of the conveyor 14. Feed ribs 56 also extend to a larger radius than ribs 42 to maximize the bending moment of inertia of the composite conveyor section.

Figure 4:
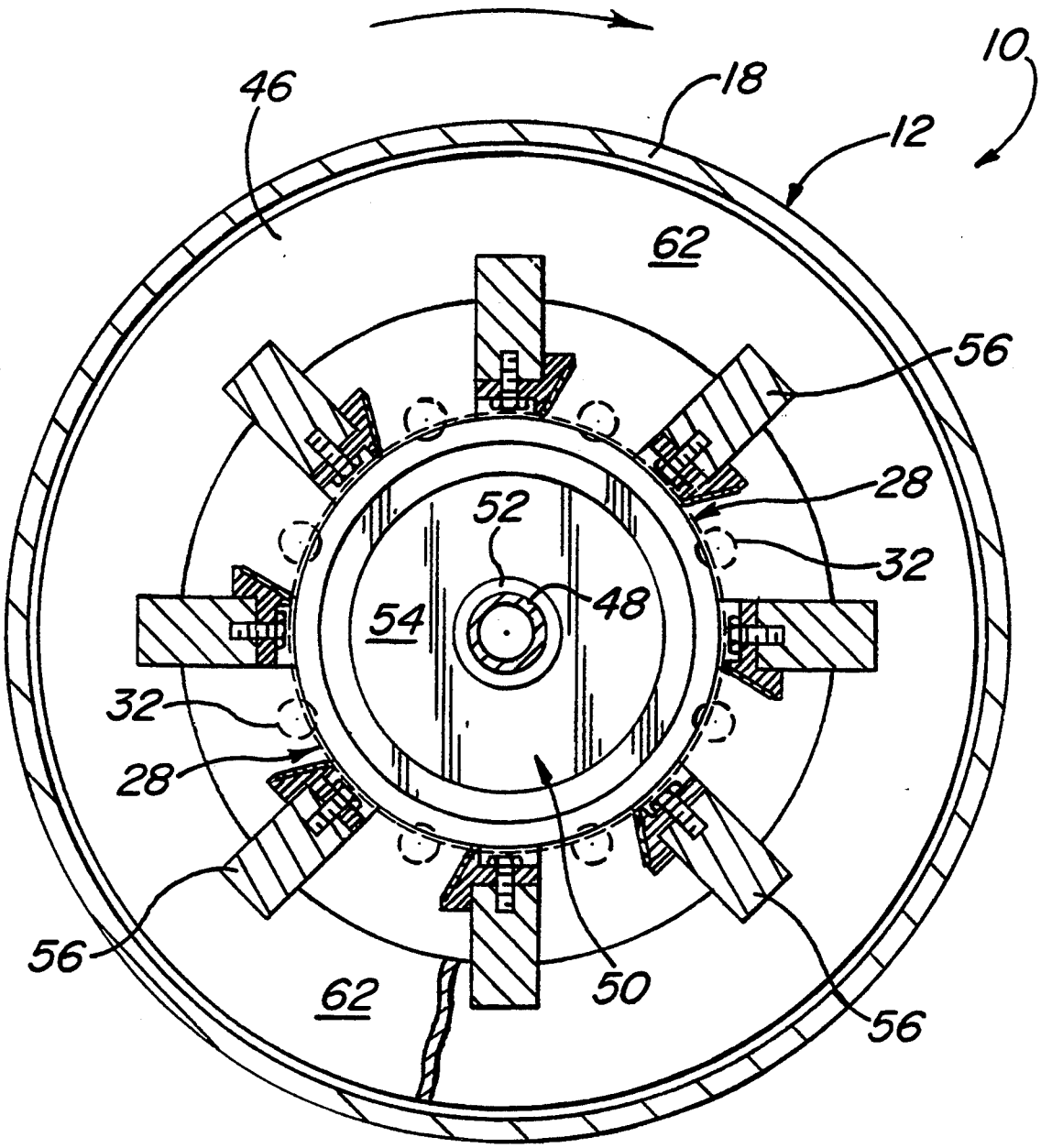
FIG. 4 shows a cross-sectional view of the feed zone of the decanter centrifuge as taken along line 4—4 in FIG. 1.

In FIG. 4, there is shown a cross-sectional view of the decanter 10 as seen in the feed portion 46 of the separating zone 64 as viewed toward bowl head 34. Again, the conveyor flights 62 are positioned on the radially-extending ribs 56 and are located closely adjacent the inside wall of the cylindrical section 18 of bowl 12. The feed pipe 48 extends into the feed zone 50 to direct the feed toward the feed target 52 and the sealing wall 54. The feed moves radially outward from the feed zone 50 and into the pond formed within the bowl (not shown). The liquid in feed zone 50 is accelerated slowly to the rotational speed of the conveyor. This slow acceleration is due to the lack of any accelerating surface within feed zone 50. The slow acceleration causes the volume of feed in zone 50 to increase so that its centrifugal pressure forces outward movement. The increased volume of feed within zone 50 results in a longer residence time for the feed and a lower rate of energy input to the feed from the conveyor. This increased volume and reduced energy rate also results in a reduction of feed solid particle breakup and an improved separation performance.

Because of the enlarged area through which the feed liquid can reach the level of the pond (without passage through nozzles and openings which create concentrated flows or jets), turbulence is avoided in the feed portion 46 of separation zone 64. The feed ribs 56 within the pond serve to create a positive acceleration of the feed in the pond. Thus, turbulence is also minimized as the feed solids move radially outward through the rotating pond. However, the liquid which initially separates from the feed (due to this rotation) is free to move radially inward toward the light phase discharge 32.

Improved stability is created in the feed portion 46 of the separating zone 64 due to the radially-extending feed ribs 56. Moreover, since the conveyor flight 62 extends through the feed portion 46, there is no reduction in the ability of the conveyor 14 to discharge heavy phase/solids out of the bowl 12 as a consequence of this improved stability. The slow acceleration of the feed in feed zone 50 reduces the velocity of the feed entering the separating zone 64 and reduces damage to the "solid" particles in the feed by reducing the rate of energy dissipation created during its introduction. Moreover, separation which has already occurred or which begins to immediately occur upon introduction of the feed into the pond is not detrimentally affected by turbulence due to continued introduction of feed.

In addition, by continuing the extension of the ribs through the separating zone 64, such as by ribs 42, radial flows and vortex turbulence near the light phase discharge 32 are minimized. This further reduces turbulence within the bowl adjacent to bowl head 34. Also, since the ribs 42 (as well as feed ribs 56 and discharge zone ribs 58) add structural stability to the conveyor, the conveyor hub 40 may be formed radially inward of the pond. This eliminates the possibility of grease collecting on the outside surface of the conveyor hub. Grease is typically lighter than the light phase/liquid and will float on the pond, collecting on an immersed conveyor hub and resulting in a restriction to the flow toward the light phase discharge 32. The separated grease will float on the pond surface and pass out through the light phase discharge path 30 through openings 32. Since the grease does not collect on the conveyor hub 40, a periodic flush of hot water is not required (further reducing cost of operation).

Figure 5:
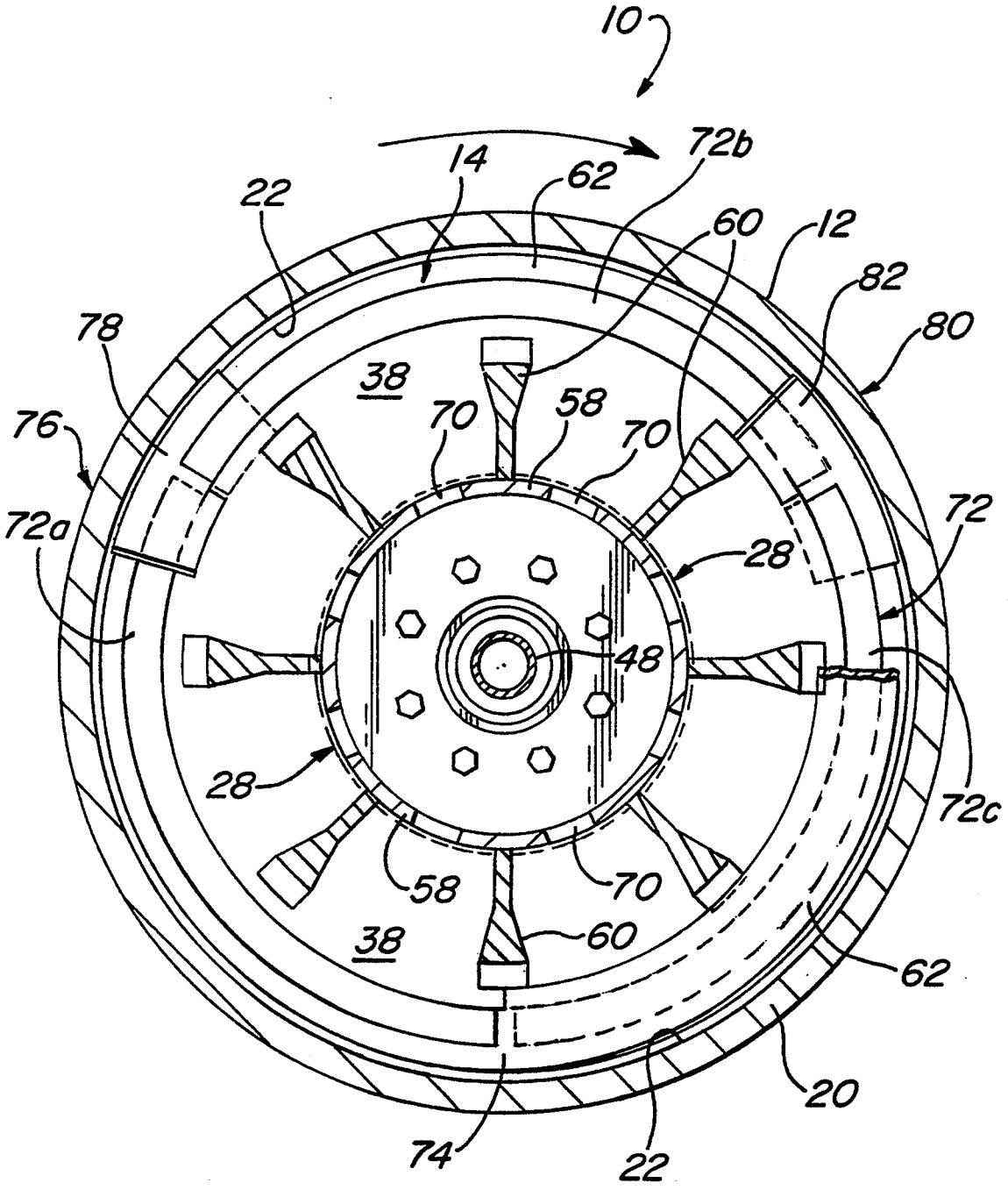
FIG. 5 is a cross-sectional view of the discharge zone of the decanter centrifuge as taken along line 5—5 in FIG. 1.

In FIG. 5, there is shown a cross-sectional view of the decanter centrifuge 10 of the present invention as taken through the discharge zone 66 (see FIG. 1) and as viewed toward the discharge zone side of the baffle 38. As can be seen in FIG. 5, the third set of ribs 60 generally take the cross-sectional form of the first set of ribs 42 (as particularly illustrated in FIG. 3). The third set of ribs 60 are angled with respect to the cylindrical surface of the conveyor hub section 58. In FIG. 5, the upper surface of each rib 60 is partially visible.

In the decanter centrifuge 10 illustrated in the drawings, the feed pipe 48 extends into the open feed zone 50 through the tapered end 20 of the bowl 12. The feed pipe 48 is usually not rotating and is positioned along the axis line of the conveyor hub 58 and the bowl 12. As discussed previously, a series of openings 70 are provided in the conveyor hub 58 within the discharge zone 66. Again, conveyor hub 58 is positioned radially inward of the spillover line 28. This allows venting from the interior of hub 58 into casing 16 through passageway 24.

In FIG. 5, the face of the baffle 38 is visible and generally forms the rear wall of the discharge zone 66. As more particularly shown in FIG. 2, the baffle forms a circular disc which is mounted to the separation zone 64 portion of the conveyor 14 by means of its attachment to the feed ribs 56. Since operational conditions for different customers may require modification of the baffle 38, an extension lip 72 is provided on the peripheral edge of the baffle plate 38. As illustrated, the extension lip 72 is formed in three portions. The first portion **72*a* extends from the position 74 where the conveyor flight 62 crosses the baffle 38 to a position approximately 120° therefrom. At this second position 76, a short conveyor flight section 78 is provided which also crosses the baffle 38. The second portion of the extension lip 72*b* extends from the second crossing position 76 to the third crossing position 80 where a second short conveyor flight 82 is provided. The third crossing position 80 is approximately 120° from the second crossing position 76 and from the crossing position 74 of the conveyor flight 62. The short conveyor flight portions 78, 82 provide conveying action in the areas of the bowl away from the continuous conveyor flight 62. The short conveyor portions 78, 82 are intended to create a more even flow of heavy phase material from the separation zone 64 through the annular restricted passageway formed by the baffle 38 (and the extension lip 72) and inside wall of the bowl 22. An even flow of separated heavy phase material into the discharge zone 66 decreases the likelihood of return flow of concentrated solids materials passing back through the restricted passageway. This reduced "secondary" flow decreases the likelihood of a washout. The additional flight portions 78 and 82** also result in an improved control of the operation of the centrifuge when varying the conveyor speed.

Figure 6:
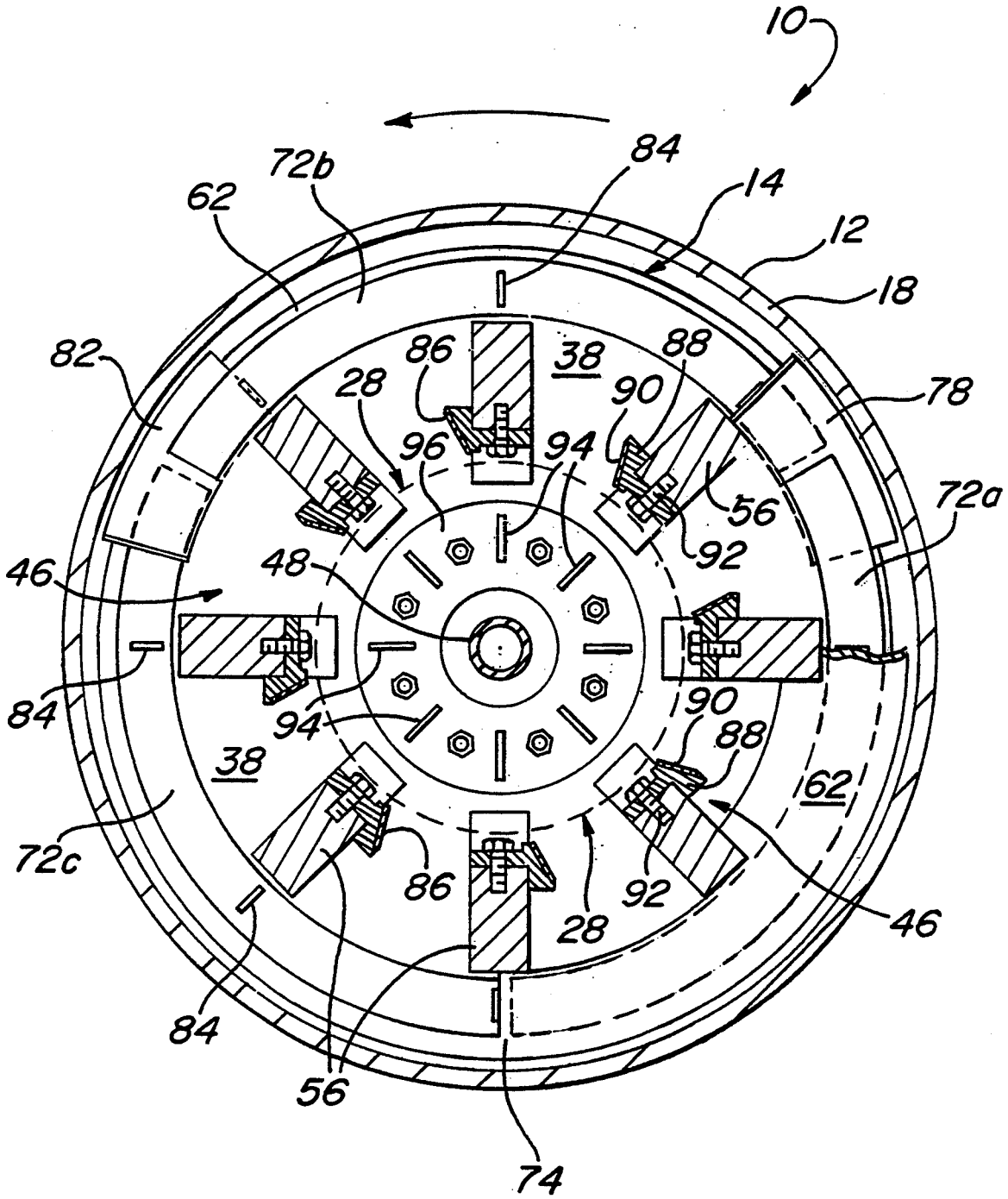
FIG. 6 is a cross-sectional view of the feed zone of the decanter centrifuge as taken along line 6—6 in FIG. 1.

FIG. 6 is a cross-sectional view of the decanter centrifuge 10 as contemplated by the present invention showing the feed zone 50 and taken in the direction of the separation zone side of the baffle 38. FIG. 6 also illustrates the position of the short conveyor flight portions 78, 82 and their relationship with respect to the crossing position 74 of continuous conveyor flight 62. A series of short ribs 84 are positioned on the face of the extension lip 72 and extend into the feed zone 46. The number of short ribs 84 correspond directly to the number of ribs 56 in the feed portion 46 of the separating zone 64. The short ribs 84 further serve to provide an even acceleration of the materials adjacent to the restricted passageway and, as such, are intended to minimize non-uniform, concentrated flows, which may result in turbulence and a channeling of the feed liquid through the separated heavy phase, creating a washout condition.

As illustrated in FIG. 6, the feed accelerating ribs 56 include a cap structure 86 on the inside surface thereof. These caps 86 are positioned radially outward of the spillover line 28 and generally form hardened wear inserts. Caps 86 are intended to minimize the effect of the accelerating feed on the inside surface of the ribs 56. Each cap 86 generally comprises a base unit 88, having a carbide or other wear resisting surface 90 thereon, and are attached to the ribs 56 by bolts 92. It is noted that the wear surface 90 is angled with respect to the radially-extending surfaces of adjacent ribs 56. Various angles and curvatures are contemplated for the accelerating face 90 of caps 86 to alter the direction of the primary feed flow as are done with conventional directional nozzles. The angle is contemplated to direct the accelerating feed into the pond centrally of the adjacent ribs 56. Thus, a channeling effect will not occur by an acceleration of material along the leading side of the ribs 56. Also illustrated in FIG. 6 is a series of feed acceleration vanes 94 which are mounted on a disc 96 attached to baffle 38. The feed acceleration vanes 94 are intended to re-direct the feed liquid which tries to leave feed zone 50 of the feed zone 46 radially outward toward the pond, thus, avoiding feed entering the hub 50. Acceleration vanes 94 further serve to stabilize the flow of feed into the pond.

The structural features of the conveyor of the present invention, i.e., the combination of a reduced conveyor hub diameter and supporting ribs, create a structural unit which is capable of withstanding high speed operating conditions on a decanter whose length to diameter ratio is greater than 4 to 1. Also, the maximum depth of pond is substantially increased without requiring a corresponding increase in the diameter of the bowl. Moreover, the contemplated feed zone and formation of the axial ribs creates a low turbulent feed and separation within the bowl, maximizing flow stability and performance results. The conveyor design illustrated, when compared to a conventional conveyor within the same bowl envelope, resulted in approximately 27% higher natural frequency and a 19% reduced weight. The higher natural frequency permits operation at higher speeds, if desired. Reduced weight results in reduced costs and easier lifting. In addition, the feed zone as illustrated results in the residence time increasing by a factor of four and an exit velocity at one-tenth that of a standard conveyor feed zone. These advantages, plus the other advantages previously mentioned, resulted in a 27% increased capacity at stable operation compared to a conventional conveyor design when processing a waste activated sludge (a "difficult-to-convey" material) under the same conditions. Also, periodic hot flushing of accumulated grease on the bowl hub is no longer needed to maintain high separation performance.

Further advantages should become apparent by those skilled in the art upon reviewing the present specification and drawings. However, the present invention may be embodied in other specific forms without departing from the spirit or essential attributes thereof, and accordingly, reference should be made to the appended claims, rather than to the foregoing specification, as indicating the scope of the invention.

I claim:

1. A centrifuge comprising: a bowl adapted for rotation about its central longitudinal axis, the bowl having a solids discharge located at a radial position with respect to the longitudinal axis; a rotatable conveyor coaxially mounted within the centrifuge bowl, the conveyor comprising a central hub extending for at least a portion of the longitudinal length of the bowl, the conveyor hub located radially inward of the radial position of the solids discharge and including a discontinuity along its length, an open feed zone formed in the discontinuity of the hub, a series of radially extending support ribs attached to the periphery of the central hub, the ribs being formed and located on the hub to maximize the bending moment of inertia of the conveyor, the series of ribs extending across the discontinuity within the hub and forming the structural integrity of the conveyor in the area of the feed zone, the conveyor further comprising a helical flight attached to the ribs and extending to a position adjacent the bowl; and feed means for introducing feed liquid into the bowl.

2. A centrifuge as claimed in claim 1 wherein a radially-extending disc is provided adjacent the discontinuity in the hub, the disc projecting radially outwardly from the hub to form a restricted passageway between the periphery of the disc and the bowl of the centrifuge.

3. A centrifuge comprising: a bowl adapted for rotation about its central longitudinal axis; a rotatable conveyor coaxially mounted within the bowl, the conveyor comprising a central hub extending for at least a portion of the longitudinal length of the bowl, a discontinuity along the length of the hub, an open feed zone formed within the hub discontinuity, a series of radially extending support ribs attached to the periphery of the central hub, the ribs formed and located to maximize the bending moment of inertia of the conveyor, the ribs extending across the discontinuity within the hub and forming the structural integrity of the conveyor in the area of the feed zone, the ribs adjacent to the discontinuity in the central hub have a greater cross-sectional area than the ribs extending from the periphery of the central hub, and a helical flight attached to the ribs and extending to a position adjacent to the bowl; and feed means for introducing feed liquid into the bowl.

4. A centrifuge as claimed in claim 3 wherein a radially-extending disc is provided adjacent the discontinuity in the hub, the disc projecting radially outwardly from the hub to form a restricted passageway between the periphery of the disc and the bowl of the centrifuge.

5. A centrifuge as claimed in claim 4 further comprising a solids discharge having a weir surface located thereon at a fixed radial position with respect to the longitudinal axis of the bowl and wherein the central hub of the conveyor is radially inward of the weir surface for the solids discharge.

6. A centrifuge of claim 5 further comprising a pair of short conveyor flight sections attached to the disc, the disc comprising three segments each forming an arc of approximately 120°, the helical flight and the short conveyor flight sections interposed between the segments.

7. A centrifuge of claim 3 wherein the ribs adjacent to the discontinuity in the hub initiate at a position radially outward of the radial position of the conveyor hub.

8. A centrifuge comprising: a bowl adapted for rotation about its central longitudinal axis, the bowl having a solids discharge located at a radial position with respect to the longitudinal axis; a rotatable conveyor coaxially mounted within the centrifuge bowl, the conveyor comprising a central hub extending for at least a portion of the longitudinal length of the bowl, the conveyor hub located radially inward of the radial position of the solids discharge, a series of radially extending support ribs attached to the periphery of the central hub,the ribs shaped to include a tapered cross sectional area at the attachment to the central hub and to progressively increase in area toward the periphery thereof, the ribs being formed and located on the hub to maximize the bending moment of inertia of the conveyor, the conveyor further comprising a helical flight attached to the ribs and extending to a position adjacent the bowl; and feed means for introducing feed liquid into the bowl.

9. A centrifuge comprising: a bowl adapted for rotation about its central longitudinal axis, the bowl having a series of solids discharge outlets located at a radial position with respect to the longitudinal axis; a rotatable conveyor coaxially mounted within the bowl, the conveyor comprising a central hub extending for at least a portion of the longitudinal length of the bowl, the central hub of the conveyor located radially inward of the solids discharge outlets, a series of radially extending support ribs attached to the periphery of the hub, the ribs formed and located to maximize the bending moment of inertia of the conveyor, the ribs shaped to include a tapered area at the attachment to the central hub and to progressively increase in area toward the periphery thereof, a helical conveyor flight attached at its radially inward most position to the periphery of the radially-extending ribs and extending to a position adjacent the bowl, thereby forming an open area between the central hub and the inner diameter of the flight; and feed means for introducing feed liquid into the bowl.

10. A centrifuge as claimed in claim 9 wherein the series of ribs include transverse openings for communication between open areas between adjacent ribs.

11. A decanter centrifuge comprising: a bowl rotatable about its central longitudinal axis; a conveyor coaxially mounted within the bowl and adapted for rotation at a differential speed with respect to the bowl, the conveyor comprising a central hub extending for a portion of the longitudinal length of the conveyor, a series of radially-extending ribs attached to the central hub portion, an open feed zone defined by an axial discontinuity in the central hub, a series of radially-extending acceleration ribs traversing the length of the feed zone and connected at opposite ends to the central hub, and a spiral conveyor flight positioned radially outward of the central hub and connected to both series of radially-extending ribs on the conveyor flight inside diameter; a separating zone radially formed inward of the bowl and radially outward of the feed zone; and feed means for directing a liquid into the feed zone for slow acceleration into the separating zone and for separation into constituent parts by the rotation of the bowl.

12. A decanter centrifuge for separately discharging light and heavy phase constituents of a feed mixture which are separated by the centrifugal force created by the rotation of the centrifuge, the centrifuge comprising: an imperforate bowl mounted for rotation about its central longitudinal axis, the bowl comprising a cylindrical section and a frusto-conical section at one end, a discharge path provided for the heavy phase material within the frusto-conical section of the bowl, a discharge path provided for the light phase material at the opposite end of the bowl from the heavy phase discharge path, the heavy phase discharge path defining a weir surface over which the separated heavy phase is discharged, the radial position of the heavy phase discharge weir surface defining a spillover position for the pond of heavy and light phase materials within the bowl; a conveyor coaxially mounted within the bowl and adapted for rotation at a differential speed with respect to the bowl, the conveyor comprising a central hub extending for at least a portion of the longitudinal length of the cylindrical section of the bowl and at least a portion of the frusto-conical section of the bowl, the hub positioned radially inward of the spillover position, a first series of longitudinally-extending ribs attached to the central hub and projecting radially from the hub, a feed zone positioned between the cylindrical section conveyor hub portion and the conical section conveyor hub portion, a second series of ribs extending across the feed zone and attached at opposite ends to the conveyor hub portions, and a conveyor flight attached to the first series of longitudinal ribs and to the second series of ribs across the feed zone; and means for feeding a feed liquid into the feed zone.

13. A centrifuge having a bowl adapted for rotation about its central longitudinal axis, the centrifuge comprising: a rotatable conveyor coaxially mounted within the centrifuge bowl, the conveyor including a central hub extending for at least a portion of the longitudinal length of the bowl and having a discontinuity therein between adjacent sections thereof, feed means formed in the discontinuity of the hub for introducing feed liquid into the bowl, the feed means introducing feed liquid into the open area of the discontinuity, a series of radially-extending support ribs attached to the adjacent sections of the conveyor hub on opposite sides of the discontinuity and projecting radially outwardly from the periphery of the central hub, and a helical conveyor flight extending axially along the length of the conveyor and extending radially to a position adjacent the bowl.

14. A centrifuge as claimed in claim 13 wherein the series of ribs extend axially along the length of the conveyor.

15. A centrifuge as claimed in claim 14 wherein the ribs attached to the conveyor hub are formed to maximize the sectional area at their projected end away from the axis of rotation and to maximize the moment of inertia of the conveyor.

16. A centrifuge comprising: a bowl adapted for rotation about its central longitudinal axis; a rotatable conveyor coaxially mounted within the centrifuge bowl, the conveyor comprising a central hub extending for at least a portion of the longitudinal length of the bowl and having a discontinuity therein between adjacent sections thereof, feed means formed in the discontinuity of the hub for introducing feed liquid into the bowl, the feed means introducing feed liquid into the open area of the discontinuity, a series of radially-extending support ribs attached to the periphery of the conveyor hub on opposite sides of the discontinuity and extend axially along the length of the conveyor hub sections, a first portion of the ribs attached to the hub and projecting radially outward therefrom, the ribs formed to maximize the sectional area at their projected end away from the axis of rotation and to maximize the moment of inertia of the conveyor, a second portion of the ribs extending across the discontinuity in the hub and having a greater cross-sectional area than the first portion of the ribs attached to the periphery of the hub, the second portion of the ribs extending along the hub discontinuity and forming the structural integrity of the conveyor in the area of the hub discontinuity, and a helical conveyor flight extending axially along the length of the conveyor and extending radially to a position adjacent the bowl.

17. A centrifuge of claim 16 further comprising a radially-extending disc attached to the periphery of the conveyor hub adjacent to the discontinuity in the hub and projects radially outward from the hub to form a restricted passageway between the periphery of the disc and the bowl of the centrifuge.

18. A conveyor for a decanter centrifuge of the type including a bowl adapted for rotation about its central longitudinal axis, the bowl having a cylindrical section and a frusto-conical section, the conveyor being coaxially mounted with the bowl and adapted for rotation at a relative speed with respect to the bowl, and feed means for introducing a liquid feed mixture into the bowl for separation into its component parts as a function of the rotation of the bowl, at least one component part being discharged as a function of the relative rotation of the conveyor with respect to the bowl, the conveyor comprising: a central hub extending for at least a portion of its longitudinal length and having a discontinuity between adjacent sections, the hub discontinuity adapted for introducing feed liquid from the teed means into the bowl, a first series of radially-extending support ribs attached to the periphery of the hub on opposite sides of the hub discontinuity and extending axially along the length of each of the hub sections, a second series of ribs extending across the hub discontinuity and forming the structural integrity of the conveyor in the area of the hub discontinuity, and a helical conveyor flight extending axially along the length of the conveyor, the conveyor flight attached to the first and second series of ribs and adapted to extend radially to a position adjacent the bowl, the conveyor flight adapted to move the separated component of the feed as a result of its relative rotation with respect to the bowl.

19. A conveyor for a decanter centrifuge as in claimed in claim 18 further comprising: a radially-extending disc adjacent the hub discontinuity and projecting radially outward therefrom, the disc adapted to form a restricted passageway between its periphery and the bowl of the centrifuge.

20. A conveyor for a decanter centrifuge as claimed in claim 19 further comprising a pair of short conveyor blades attached to the disc approximately 120° from the conveyor flight, the blades adapted to assist the discharge movement of the separated component of the feed in the area of the disc.

21. A conveyor for a decanter centrifuge as claimed in claim 19 wherein the disc is adapted to be positioned on the conveyor adjacent the frusto-conical portion of the bowl of the centrifuge, and one section of the central hub is positioned on the opposite side of the disc from the hub discontinuity and the one section of the hub at least partially positioned in the frusto-conical portion of the bowl of the centrifuge.

22. A conveyor for a decanter centrifuge as claimed in claim 21 wherein the attachment of the conveyor flight to the periphery of the first series of ribs forms an open area between the central hub and the inner periphery of the flight.

23. A conveyor for a decanter centrifuge as claimed in claim 22 wherein the pitch of the helical conveyor flight varies along the length of the conveyor.

24. A conveyor for a decanter centrifuge as claimed in claim 21 wherein the pitch of the helical conveyor flight decreases along the length of the conveyor across the discontinuity in the hub and within the frusto-conical portion of the bowl.

* * * * *